US010279228B2

(12) United States Patent
Smith

(10) Patent No.: US 10,279,228 B2
(45) Date of Patent: May 7, 2019

(54) PUTTING TRAINING DEVICE

(71) Applicant: Thomas Bobby Smith, Germantown, MD (US)

(72) Inventor: Thomas Bobby Smith, Germantown, MD (US)

( * ) Notice: Subject to any disclaimer, the term of this patent is extended or adjusted under 35 U.S.C. 154(b) by 0 days.

(21) Appl. No.: 13/791,660

(22) Filed: Mar. 8, 2013

(65) Prior Publication Data

US 2013/0237341 A1 Sep. 12, 2013

Related U.S. Application Data

(60) Provisional application No. 61/608,880, filed on Mar. 9, 2012.

(51) Int. Cl.

| | |
|---|---|
| ***A63B 53/02*** | (2015.01) |
| ***A63B 53/04*** | (2015.01) |
| ***A63B 60/22*** | (2015.01) |
| ***A63B 69/36*** | (2006.01) |
| ***A63B 71/06*** | (2006.01) |
| ***A63B 53/00*** | (2015.01) |
| ***A63B 53/14*** | (2015.01) |

(Continued)

(52) U.S. Cl.

CPC ..... *A63B 53/0487* (2013.01); *A63B 53/007* (2013.01); *A63B 53/08* (2013.01); *A63B 53/14* (2013.01); *A63B 60/22* (2015.10); *A63B 69/3676* (2013.01); *A63B 71/0622* (2013.01); *A63B 60/32* (2015.10); *A63B 2053/027* (2013.01); *A63B 2053/028* (2013.01); *A63B 2053/0441* (2013.01); *A63B 2071/0633* (2013.01); *A63B 2071/0694* (2013.01)

(58) Field of Classification Search

CPC ..... A63B 69/3676; A63B 71/0622; A63B 53/007; A63B 53/08; A63B 53/14; A63B 2053/027; A63B 60/32; A63B 2071/0633; A63B 2071/0694; A63B 2053/0441; A63B 2053/028; A63B 60/22; A63B 53/0487

See application file for complete search history.

(56) References Cited

U.S. PATENT DOCUMENTS 331,898 A 12/1885 Marlin
847,487 A * 3/1907 Maxwell ..... 384/524
(Continued)

FOREIGN PATENT DOCUMENTS

DE 102010017079 A1 * 12/2011 ..... A63B 53/02
JP 04327865 A * 11/1992 ..... A63B 53/16
JP 09103520 A * 4/1997

OTHER PUBLICATIONS

SKF USA Inc., "Bearing Installation and Maintenance Guide," publication 140-170 (2001).
(Continued)

*Primary Examiner* — Stephen L Blau
(74) *Attorney, Agent, or Firm* — Dentons US LLP

(57) ABSTRACT

A golf club device for improving one's golf abilities is disclosed. The device includes a head, and a shaft where the head is rotatably connected to at least an upper portion of the shaft. Rotation is achieved with an angular rotation mechanism. The angular rotation mechanism may include a variable resistance feature. The angular rotation mechanism may be positioned in or on the head, or it may be positioned in the shaft. One or more visual alignment indicators may also be employed.

11 Claims, 14 Drawing Sheets

(51) Int. Cl.
*A63B 53/08* (2015.01)
*A63B 60/32* (2015.01)

(56) References Cited

U.S. PATENT DOCUMENTS 1,122,880 A 12/1914 Pflueger
1,529,305 A * 3/1925 Gatke ..... 473/232
1,587,082 A * 6/1926 Mattern ..... 473/201
1,613,360 A * 1/1927 Rigby ..... 473/296
2,447,080 A * 8/1948 Meier ..... G10D 3/003 135/86
2,553,337 A 5/1951 Shafer
2,865,635 A * 12/1958 Jessen ..... 473/201
3,206,206 A * 9/1965 Santosuosso ..... A63B 53/007 473/244
3,937,585 A * 2/1976 Cattermole ..... 403/300
4,222,567 A * 9/1980 Shabala ..... 473/242
4,317,568 A * 3/1982 Green ..... 473/238
4,826,168 A * 5/1989 McGuire et al. ..... 473/295
4,878,666 A * 11/1989 Hosoda ..... 473/247
5,058,891 A * 10/1991 Takeuchi ..... 473/201
5,125,657 A * 6/1992 Beil ..... A63B 53/007 473/293
5,152,533 A * 10/1992 Radakovich ..... 473/206
5,259,617 A * 11/1993 Soong ..... 473/305
5,290,035 A * 3/1994 Hannon et al. ..... 473/252
5,308,067 A * 5/1994 Cook ..... A63B 53/0487 473/341
5,388,827 A * 2/1995 Reynolds, Jr. ..... A63B 53/02 473/288
5,390,920 A * 2/1995 Nickum ..... 473/246
5,593,234 A 1/1997 Liston
5,647,681 A * 7/1997 Chen ..... 403/270
5,755,625 A * 5/1998 Jackson ..... A63B 53/007 473/313
5,797,176 A * 8/1998 Rose ..... A63B 53/0487 164/397
5,951,412 A * 9/1999 Rose ..... A63B 53/0487 473/340
5,988,547 A 11/1999 Koelewyn
6,039,657 A * 3/2000 Gidney ..... A63B 53/0487 473/252
6,083,113 A * 7/2000 Bernhardt ..... A63B 53/007 473/131
6,267,689 B1 * 7/2001 Ambrose ..... A63B 53/0487 473/251
6,648,771 B1 * 11/2003 Mills ..... 473/244
6,743,116 B2 * 6/2004 Wilbur ..... 473/296
6,890,269 B2 * 5/2005 Burrows ..... A63B 53/02 473/307
7,040,999 B2 * 5/2006 Trainello ..... A63B 53/007 473/238
7,367,896 B2 * 5/2008 Jackson ..... A63B 53/007 473/246
8,241,138 B2 * 8/2012 Maglaque et al. ..... 473/282
8,267,806 B2 * 9/2012 Karube ..... 473/300
8,419,563 B2 * 4/2013 Sander ..... A63B 53/02 473/244
8,517,855 B2 * 8/2013 Beach et al. ..... 473/307
8,758,155 B1 * 6/2014 Demkowski et al. ..... 473/296
8,876,626 B2 * 11/2014 Suwa et al. ..... 473/307
2001/0041626 A1 * 11/2001 Madelle et al. ..... 473/295
2004/0142763 A1 * 7/2004 Zarganis ..... A63B 69/3685 473/340
2004/0198528 A1 * 10/2004 Balcer ..... A63B 53/007 473/293
2007/0093313 A1 * 4/2007 Johnson ..... A63B 53/0487 473/340
2009/0270194 A1 * 10/2009 Casati, Jr. ..... 473/201
2014/0335966 A1 * 11/2014 Aguinaldo et al. ..... 473/239

OTHER PUBLICATIONS

Bikes Not Bombs, "Earn-A-Bike Instructors Manual," chapter 5 (2000).

* cited by examiner

PUTTING TRAINING DEVICE

This application claims priority to U.S. Provisional Application No. 61/608,880, filed Mar. 9, 2012, which is hereby incorporated by reference

BACKGROUND

Field of the Disclosure

The present invention relates to a training device for the sport of golf. More specifically, the present invention relates to a training device that provides immediate, real-time muscular and neural sensory feedback to a golfer for the purpose of improving the golfer's golf putting stroke.

Background of the Disclosure

Golf is a popular recreational and professional sport that requires significant coordination between the golfer's mind and body. When the ball is on the green, the golfer, of course, uses a specific club, a putter, to "putt" the ball into a cup sunk below the surface of the green. The cup, or hole, is only 4.24 inches. As such, putting the golf ball in the hole in as few strokes as possible can be quite a challenge and requires a great deal of skill.

Professionals and amateurs alike recognize the need for practice and training to imprint muscle memory necessary to improve their game, and in particular, their putting stroke. In fact, the putting stroke is quite often recognized as the most difficult aspect of the game.

The present invention was conceived during the inventor's participation in an amateur golf tournament. During the tournament, the putter broke in such a way it appeared to render the putter unusable. The putter head became loose on the shaft, such that the head would spin around the club shaft when the head struck the ball during the putting stroke. The inventor attempted to utilize the broken putter and realized that the only way the putter was effective was through a dramatic reduction in stroke speed with considerable concentration and focus on striking the ball at the "sweet spot" of the head. After completing the tournament, it became apparent to the inventor that the broken putter could be developed into an effective training tool.

Discussion of the Related Art

Recently, several devices have been marketed that allegedly improve a golfer's putting stroke. Some of these devices vary the shape of the putter head, thus forcing the golfer to strike the ball with greater precision. For example, one device employs a "V" shaped, pointed striking surface. This device attempts to provide feedback to the golfer in that the ball will move in the wrong direction if the ball is struck off center. A similar device employs an oval or "egg" shaped surface.

Of course, there are other designs that attempt to teach repeated ball impact at the "sweet spot" of the club face. Some employ grooves or pins to isolate the sweet spot. Others move or shrink the sweet spot. At least one uses a sensing device to track the golfers putting stroke. Yet, another delivers audible feedback if the golfer's swing plane is off line.

However, none of the prior art devices succeeds at developing muscle memory, a subconscious retention of motor skills through repeating a movement, in the same manner as the present invention.

SUMMARY OF THE DISCLOSURE

The present invention, in accordance with the exemplary embodiments described herein, involves a putting training device that overcomes the aforementioned disadvantages associated with the prior, related art devices. In general, the present invention does so by employing a rotatable portion that forces the golfer to develop improved putting stroke body mechanics.

One advantage of the present invention is that is better provides the golfer with the ability to learn body positioning, weight distribution and stability of legs, knees, hip, arms and shoulders for true putting. It teaches posture with eyes directly over the ball, with knees slight bent forward, and arms in a relaxed position.

Another advantage of the present invention is that it is better at teaching the golfer proper golf ball-putter head alignment with visualization.

Another advantage of the present invention is that it is better at teaching the golfer to strike the golf ball with the sweet spot of the putter head face with consistency and accuracy in order to better control ball path direction and speed. In order for the ball to travel in a true line after impact the golf ball has to be hit with the sweet spot.

Another advantage of the present invention is that it is better at teaching the golfer to strike the golf ball with the right amount of power and speed needed for every distance with consistency. It does this, at least in part, by forcing the golfer to adjust their stroke tempo, or else the putter head will swivel or spin around during the stroke.

Another advantage of the present invention is that it is better at teaching the golfer to keep their putter head low to the ground throughout the putting stroke. This position should be maintained even after putter impact with the golf ball.

Another advantage of the present invention is that it better helps the golfer to determine the proper putter shaft length and hand position.

Additional features and advantages will be set forth in the description which follows, and in part will be apparent from the description, or may be learned by practice of the invention. The objectives and other advantages of the present invention will be realized and attained by the structure particularly pointed out in the written description and claims hereof as well as the appended drawings.

To achieve these and other advantages and in accordance with the purpose of the present invention, as embodied and broadly described, a golf club device comprising a shaft; and a head rotatably connected to the shaft.

In another aspect of the present invention, a golf club device comprising a head; a first shaft portion; and a second shaft portion rotatably connected to the first shaft portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

In the drawings.

DETAILED DESCRIPTION OF THE ILLUSTRATED EMBODIMENTS

Figure 1:
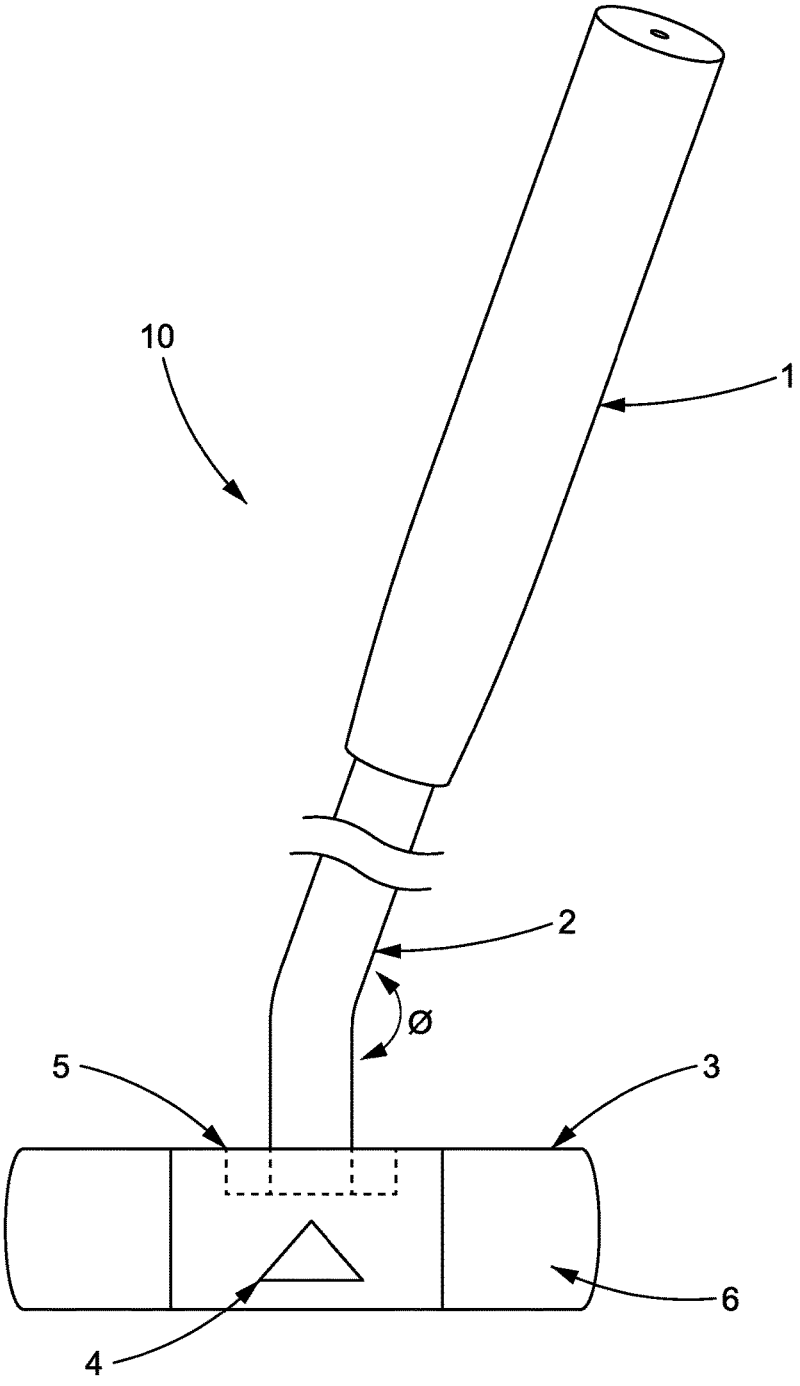
FIG. 1 illustrates a putting training golf club according to exemplary embodiments of the present invention.

Reference will now be made in detail to exemplary embodiments of the present invention as illustrated in the accompanying drawings. The disclosed device, in accordance with these embodiments, provides direct sensory feedback to a golfer working to improve his or her putting through the use of a "TFT" (Tempo-Focus-Trust) approach. Mastering these three elements will improve the golfer's putting.

Tempo is the rate of motion of the putting stroke including the backswing, forward swing through impact with the golf ball, and follow through after impact. The stroke tempo may vary based on the length of the putt, location of the golf ball relative to the hole, and conditions of the putting surface. The proper acceleration and deceleration of the putter head through the stroke may be learned by using the disclosed training device.

Variable rotational resistance adjustment provides a means for a golfer to fine tune and progressively improve the putting tempo. By virtue of the variable rotational resistance, the sensitivity of the putting head to rotation caused by an improper stroke can be adjusted based on the ability of the golfer. A novice golfer with poor putting stroke mechanics may become discouraged or frustrated at their inability to show or maintain improvement. To mitigate this, a golfer may increase the rotational resistance to de-sensitize the putter head's reaction to improper strokes and be more forgiving of miss hits. As a golfer's ability improves, the rotational sensitivity can be increased to require a more precise putting stroke without causing putting head rotation.

Focus refers to the golfer's attention to the putting line. The direction of the line a ball will travel following impact with the putter head is extremely important. A club head that deviates from the optimal orientation relative to the putting line during the stroke becomes obvious to the golfer using the disclosed device because the ball will travel off the intended line and not at the intended speed. The disclosed device trains a golfer's muscles to maintain the proper club head orientation through the swing path to achieve the desired result so the golfer can focus on the optimal putting line, one that will send the golf ball to the hole.

Trust is the golfer's confidence in his or her swing mechanics. The disclosed device trains the mind and body to maintain optimal stroke mechanics and allow the golfer to focus on the environmental conditions of the putt. Proper mechanics may be achieved if the putter head of the disclosed device does not spin as a result of the putting stroke. For example, if the acceleration/deceleration is excessive, the rotation mechanism will send instant mechanical feedback to the golfer's brain through sensory feedback.

As mentioned above, the present invention involves the use of an angular rotation mechanism, where the putter head rotates about a top portion of the training device held in a golfer hands (e.g. the golf club grip). This angular rotation mechanism may employ variable resistance, as mentioned above, adjusted to match to a golfer's ability level as further described below. The TFT training approach is to adjust the resistance component of the angular rotation mechanism as the golfer's putting stroke improves, thus providing progressive, fine-tuned, direct muscular and neural sensory feedback to the golfer so that the putting stoke is modified each time a stroke is completed. A regular training regimen of steady use over time with the putter training device should lead to consistent improvement.

Sensory feedback is achieved by comparing actual results to the intended result immediately after completing a putting stroke. Visual feedback occurs by perceiving the speed and path of the ball following impact with the head of the putter and the position of the golf ball and putting head after the stroke is completed. Audible feedback occurs by noticing different sounds caused by the putting head face striking the golf ball or by the rotation of the putter head. Touch feedback may occur by the "feel" in the golfer's hands throughout the stroke and putting head impact with the golf ball.

The learning and improvement process is iterative in that adjustments to putting technique during subsequent strokes may be made based on previous results. The disclosed putting training device provides feedback to the user, who, as a result learns proper breathing, body position, back swing, forward swing, ball strike, and follow-through.

FIG. 1 shows a front view of a putting training device according to exemplary embodiments of the present invention. In FIG. 1, the main features of a putting training device 10 are shown. These features include a grip 1, a shaft 2, and a head 3. The shaft 2 connects the grip 1 to the head 3. In this employed embodiment, the shaft 2 is connected to the head 3 through an angular rotational mechanism 5, shown as embedded into the head 3. The angular rotation mechanism 5 has an axis of rotation about which two portions rotate with respect to each other.

In the exemplary embodiment of FIG. 1, the grip 1 is attached to one end of a shaft 2. The grip 1 may effectively increase the diameter of the shaft 2 to allow for more comfortable handling. The grip 1 may be leather, rubber, plastic, or any other suitable material to improve a golfer's grip and minimize rotation or slipping relative to the golfer's hands during the putting stroke.

The shaft 2 is preferably cylindrical in shape and may be constructed of any suitable material including, but not limited to, variations of wood, metal, fiberglass, graphite, plastic, or combinations thereof. The shaft 2 may vary in length to accommodate the height and preference of the golfer. The shaft 2 may be straight, bent, stepped, double bent, or any variation thereof. FIG. 1 shows a bent shaft 2 at an angle θ other than 90 degrees between the putting head 3 and the grip 1. As shown, one end of the shaft 2 is connected to the angular rotational mechanism 5. The opposite end of a shaft 2 is connected to the grip 1.

The putting head 3 may be constructed of any suitable material including, but not limited to, variations of wood, metal, plastic, graphite, ceramic, glass, or combinations thereof. Typically the face 6 of the head 3 is flat or substantially flat, as it is this surface that makes contact with the golf ball. The face 6 may include an insignia 4. The insignia 4 may assist the golfer to more accurately align and strike the golf ball. The insignia 4 may be made of a different material than the face 6. A triangle shape is shown for the insignia 4, but the insignia 4 could have any shape or design. The insignia 4 may also be any design, stamp, or logo that could be for ornamental or branding purposes or combinations thereof.

The overall shape of head 3 may vary. For example, it may be triangular, rectangular, blade-shaped, hemispheric, oval, or any other suitable shape.

The head 3 may be symmetrically weighted about the rotational axis of the angular rotational mechanism 5. However, the head 3 may include means (not shown) by which the golfer may alter the weight of the head 3, including a means for adjusting the weight such that the weight of head 3 is not symmetric about the rotational axis of the angular rotational mechanism 5. This may be accomplished using any means weights may be fastened at different locations on the head 3.

In the exemplary embodiment of FIG. 1, the angular rotation mechanism 5 is embedded in the head 3 flush with or below the top surface of the head 3. It is also possible that the angular rotation mechanism 5 is located on top of the putting head 3 rather than embedded below the top surface. The angular rotation mechanism 5 allows the head 3 to rotate about the shaft 2. The angular rotation mechanism 5 may allow both clockwise and counter clockwise rotation. The angular rotation mechanism 5 may be connected to the head 3 by force fit, adhesive, fastener, bonding, welding, integral fabrication, or any other suitable connection technique or means. The angular rotation mechanism 5 may be constructed using techniques and components, so as to allow for relative movement, including a bearing, pin and sleeve, axel, ball and socket, and the like. The angular rotation mechanism 5 may be constructed with components known in the art, for example, those disclosed in U.S. Pat. Nos. 331,898; 847,487; and 5,593,234, which are hereby incorporated in their entirety by reference. The angular rotational mechanism 5 may be sealed to prevent dirt and moisture penetration which may foul and degrade operation over time.

Figure 2:
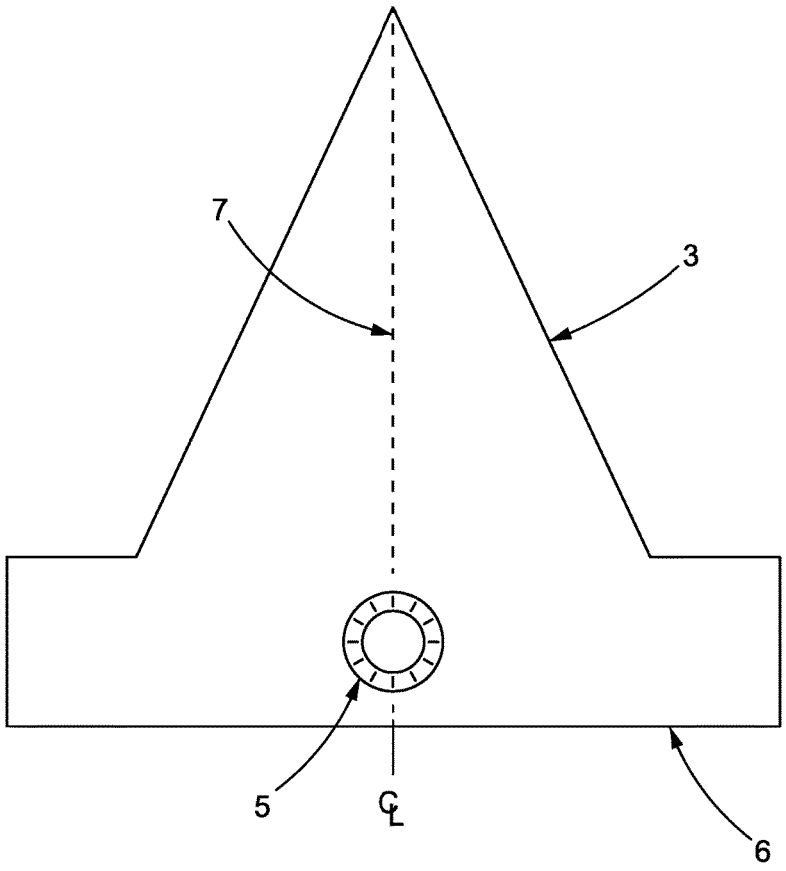
FIG. 2 illustrates an exemplary plan view of the training golf club head shown in FIG. 1.

FIG. 2 illustrates a plan view of an exemplary head 3 consistent with the club shown in FIG. 1. As can be seen, the head 3 is general triangularly shaped, although other shapes are possible as discussed below. A location of the angular rotation mechanism 5 is shown. FIG. 2 shows a triangular protrusion in a direction opposite the head face 6. The point of the triangular protrusion may coincide with center line 7, which bisects head 3. The center line 7 may also bisect the angular rotation mechanism 5, as shown.

Figure 3:
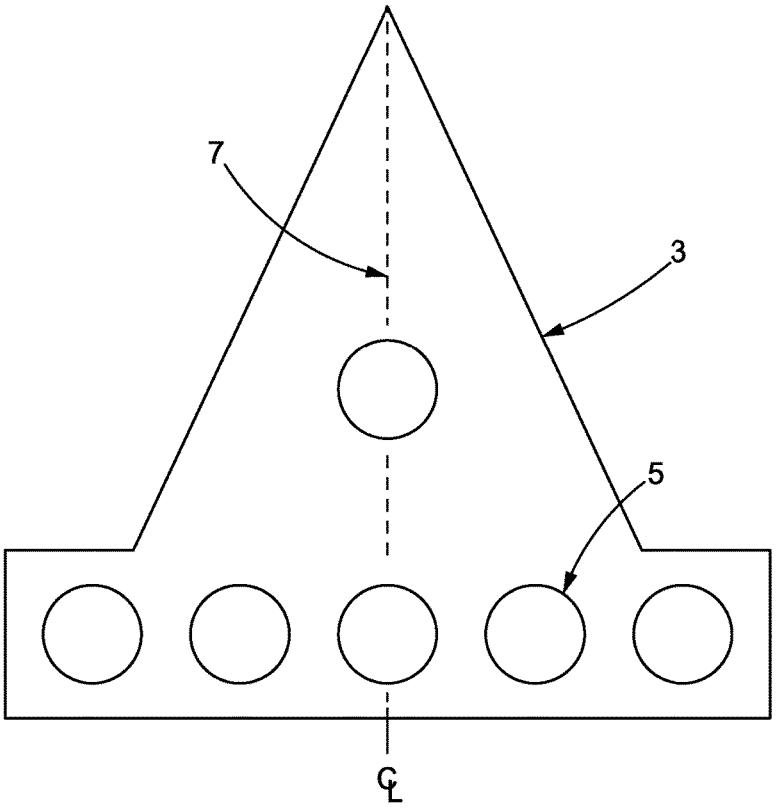
FIG. 3 illustrates possible locations of the variable resistance, rotational response device according to exemplary embodiments of the present invention.

However, as shown in FIG. 3, the angular rotation mechanism 5 may be located at other positions on head 3 as long as the head 3 is free to rotate relative to shaft 2. In this figure, the angular rotation mechanism 5 is shown in any one of 6 possible locations on the putting head 3. Still, other locations are possible.

Figure 4:
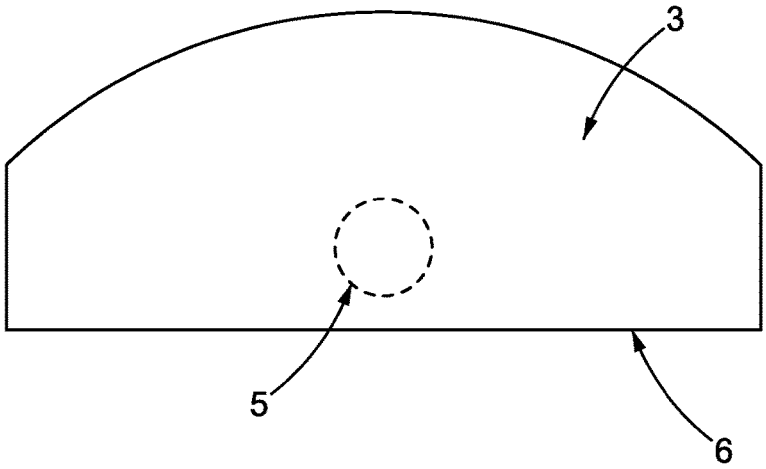
FIG. 4 illustrates a plan view of another exemplary embodiment of a training golf club head according to the current disclosure.
Figure 5:
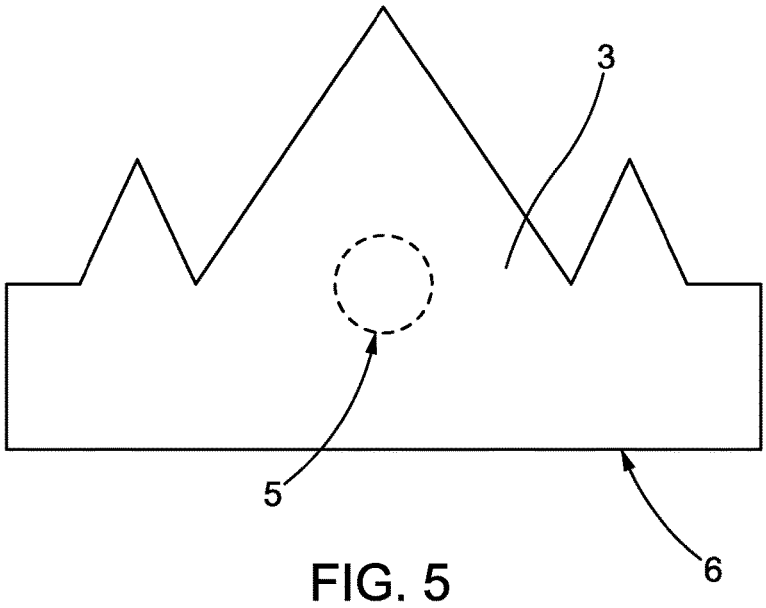
FIG. 5 illustrates a plan view of another exemplary embodiment of a training golf club head according to the current disclosure.
Figure 6:
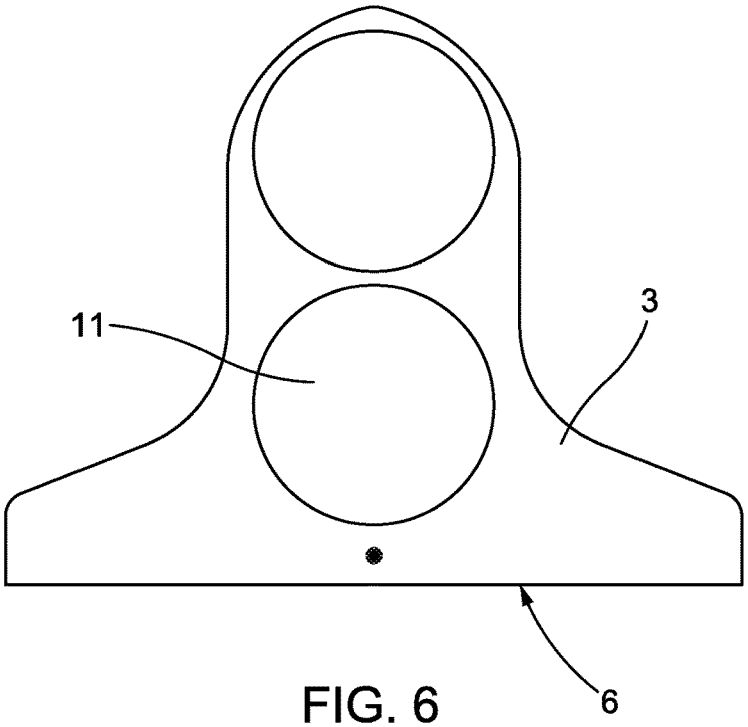
FIG. 6 illustrates a plan view of another exemplary embodiment of a training golf club head according to the current disclosure.
Figure 7:
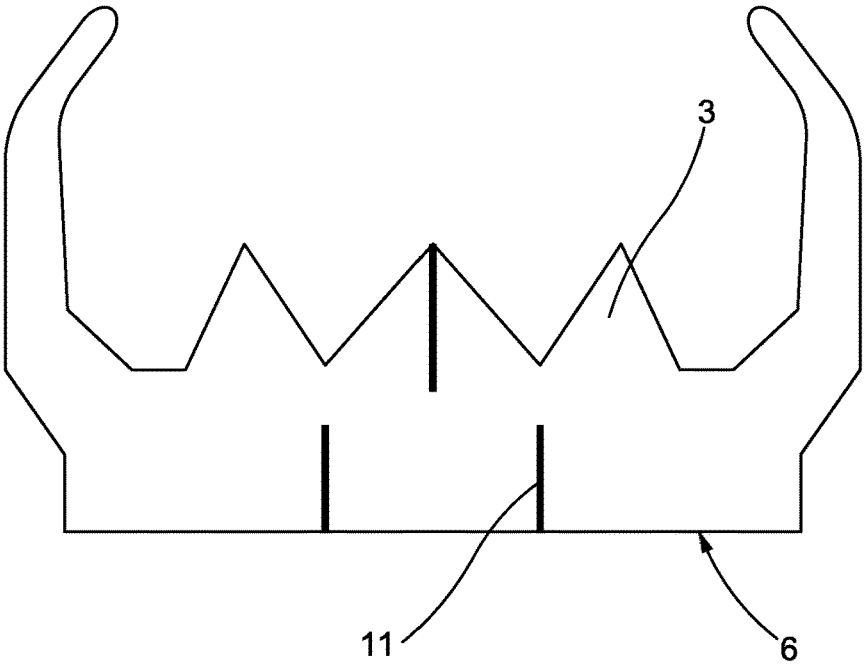
FIG. 7 illustrates a plan view of another exemplary embodiment of a training golf club head according to the current disclosure.
Figure 8:
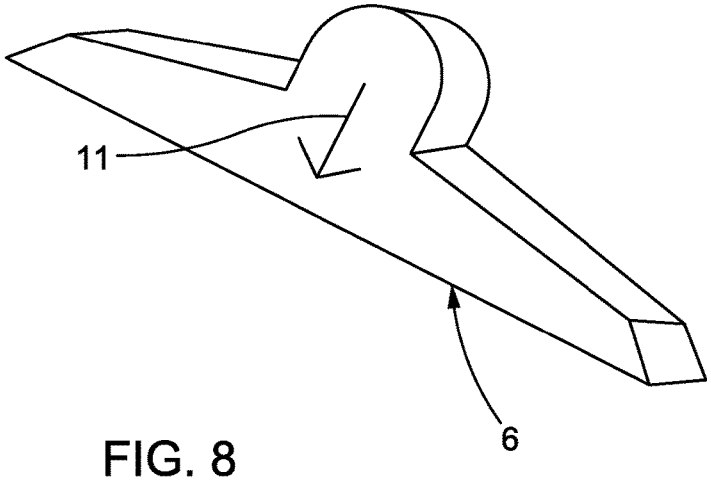
FIG. 8 illustrates a view of another exemplary embodiment of a training golf club head according to the current disclosure.
Figure 9:
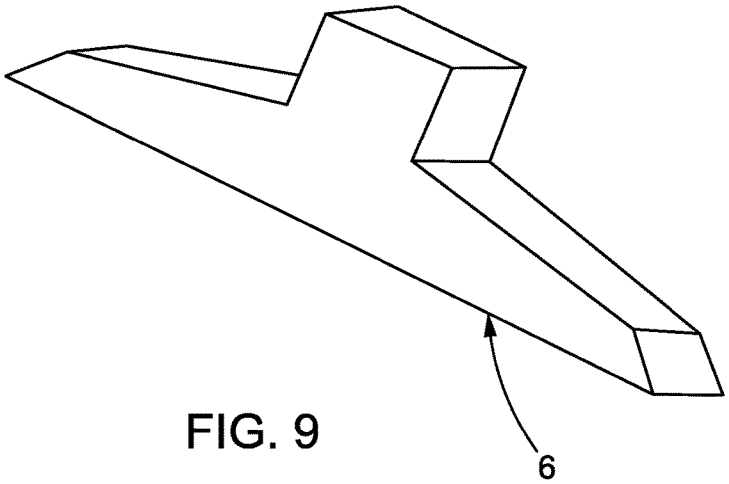
FIG. 9 illustrates a view of another exemplary embodiment of a training golf club head according to the current disclosure.
Figure 10:
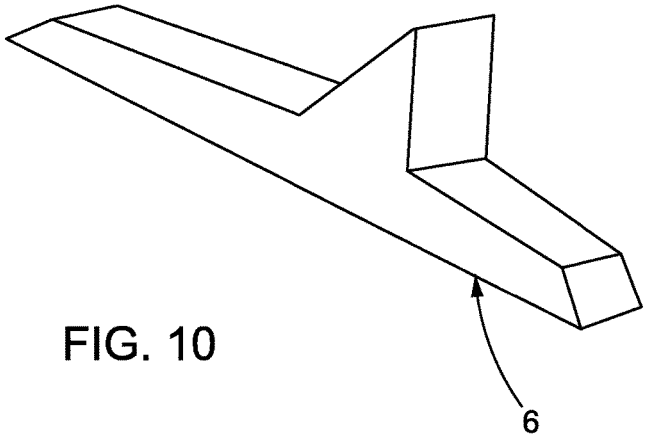
FIG. 10 illustrates a view of another exemplary embodiment of a training golf club head according to the current disclosure.
Figure 11:
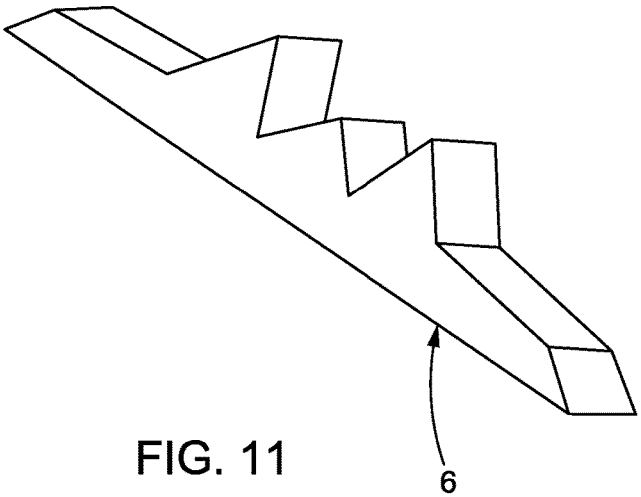
FIG. 11 illustrates a view of another exemplary embodiment of a training golf club head according to the current disclosure.
Figure 12:
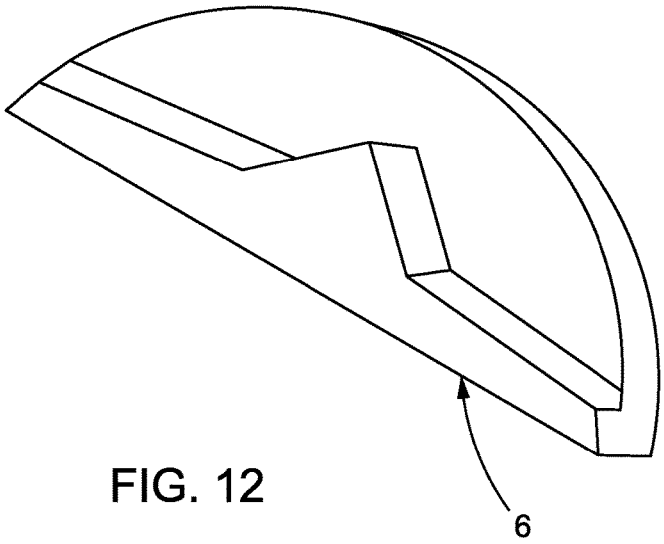
FIG. 12 illustrates a view of another exemplary embodiment of a training golf club head according to the current disclosure.
Figure 13:
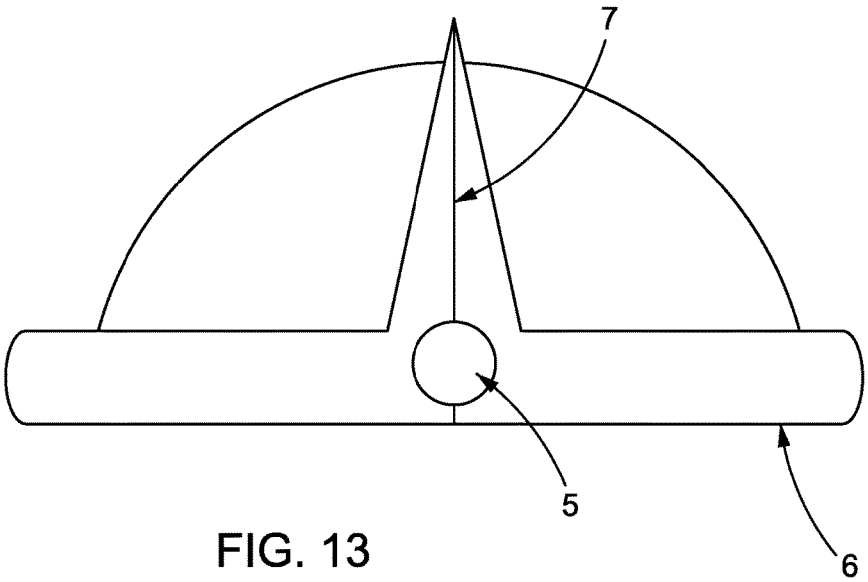
FIG. 13 illustrates a view of another exemplary embodiment of a training golf club head according to the current disclosure.

FIGS. 4-13 illustrate views of other exemplary shapes for head 3. These are exemplary and in no way limiting. More specifically, FIG. 4 shows a head 3 with a rounded shape side opposite the face 6. FIG. 5 shows an alternate shape with three triangular protrusions opposite the face 6. A prominent centered rounded protrusion opposite the face 6 is shown in FIG. 6. FIG. 7 shows a "saber tooth" design with two very prominent lateral protrusions opposite the face 6. FIG. 8 shows a putter head design with a half-oval protrusion opposite the face 6. FIG. 9 shows a putter head with a rectangular protrusion opposite the face 6. FIG. 10 shows a narrower putter head with a single triangular shaped protrusion opposite the face 6. FIG. 11 shows a similar design to FIG. 10 with three triangular protrusions opposite the face 6. FIG. 12 shows a putter head design with a combination of circular and triangular features opposite face 6. FIG. 13 is a plan view of a design similar to that of FIG. 12 with a triangular feature protruding past a circular feature opposite from face 6. FIG. 13 also shows a possible location for the angular rotation mechanism 5 and center line 7. Alternate head geometries, shapes, and combinations of features are possible.

Figure 14:
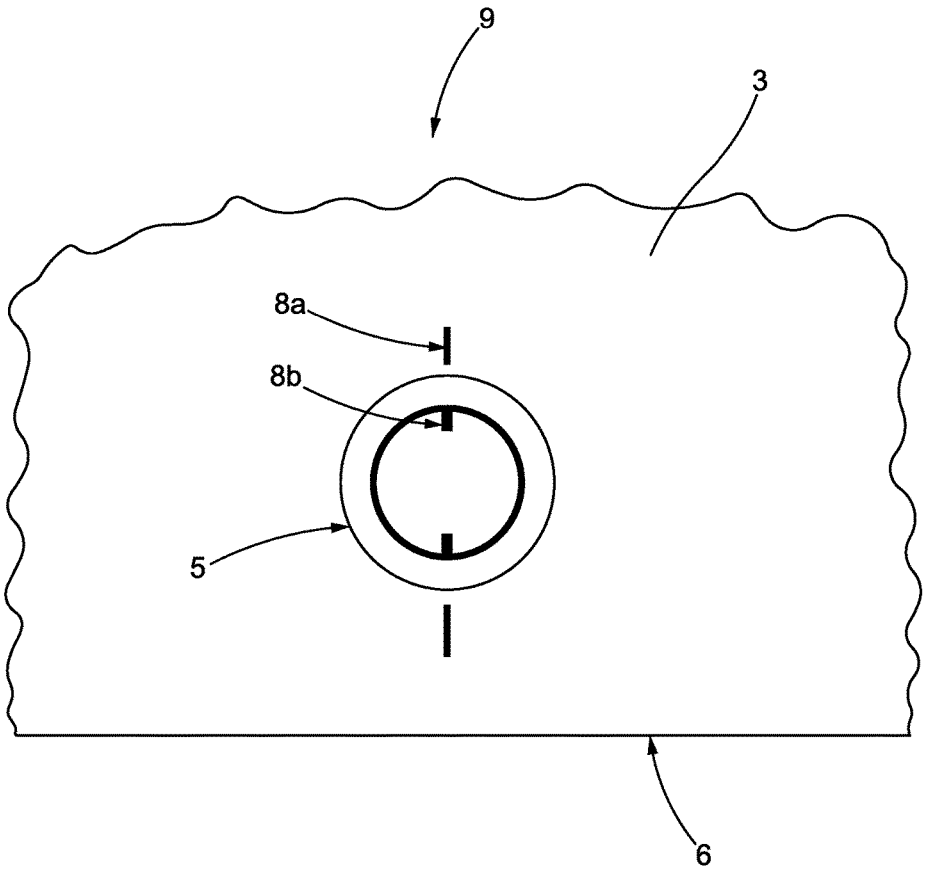
FIG. 14 illustrates an alignment system of a training golf club according to the current disclosure.

The putting training device, in accordance with exemplary embodiments, may include a rotational alignment system 9 that indicates the angular position of the head 3 about its rotational axis. The rotational alignment system 9 may include alignment marks, such as reference dots, lines, holes, or any other suitable indicator that visually conveys the angular position of the head 3. For example, FIG. 14 shows a plan view of a head 3 that includes a rotational alignment system 9. The rotational alignment system 9 includes a set of alignment marks 8*a* and 8*b*. Alignment mark 8*a* is located on the head 3 and alignment mark 8*b* is located on the angular rotation mechanism 5. In FIG. 14, alignment marks 8*a* and 8*b* are aligned relative to each other. As the head 3 rotates about the axis of rotation of the angular rotation mechanism 5, the alignment of alignment mark 8*a* and alignment mark 8*b* will vary. The amount of angular deviation between alignment marks 8*a* and 8*b* when the head 3 rotates may provide visual feedback to the golfer after striking a golf ball as suggested above.

Turning our attention back to FIGS. 6-8, a ball alignment indicator 11 may be included on the head 3. The ball alignment indicator 11 may be used as a visual aid by the golfer to align the head 3 with the golf ball prior to and during the putting stroke. FIGS. 6 and 7 show top plan views of exemplary ball alignment indicators 11. FIG. 6 illustrates a two-ball type ball alignment indicator 11 and FIG. 7 illustrates an exemplary ball alignment indicator 11 that employs three linear alignment marks. FIG. 8 illustrates a "semi-T" ball alignment indicator 11. Alternatively, the ball alignment indicator 11 could be a line through the center line 7 as shown in FIGS. 2 and 3. Still further, the ball alignment indicator 11 may involve a groove, dot, line, arrow, head protrusion, or other suitable alignment indications or combinations thereof.

The putting training device also may include a mechanism (not shown) to adjust the resistance of rotation of the angular rotation mechanism 5. As one skilled in the art will readily appreciate, adjusting the resistance will make the angular rotation mechanism 5 more or less sensitive to rotation. Greater resistance will cause less rotation in response to a miss hit and less resistance will cause a greater amount of rotation in response to a miss hit, assuming all other factors are equal. The resistance adjustment mechanism (not shown) may be integrated into the angular rotation mechanism 5 and allow a golfer, caddy, or technician to adjust the sensitivity according to the golfer's preference level or skill. The variable resistance mechanism may employ a spring, belt, set screw, collapsible collet, or any other suitable means. The resistance adjustment may be accomplished by hand or by using a tool such as a hand tool, golf shoe cleat wrench, divot repair tool, or the like.

Further the variable resistance mechanism may include any means to visualize or aid in determining the relative sensitivity of the adjustment. For example, there may be a graduated dial, scale, alignment mark, audible click, detent position, or any other means.

Alternate designs for varying the resistance are also possible. One alternative is to provide separate heads 3 each with a different angular rotation mechanism 5 exhibiting a different degree of resistance. The heads 3 may be removable so that the golfer can change heads to change the rotational resistance. Alternatively, golf clubs may be manufactured in a series, each having a rotating head 3 with a different rotational resistance fixed during manufacturing.

Figure 15:
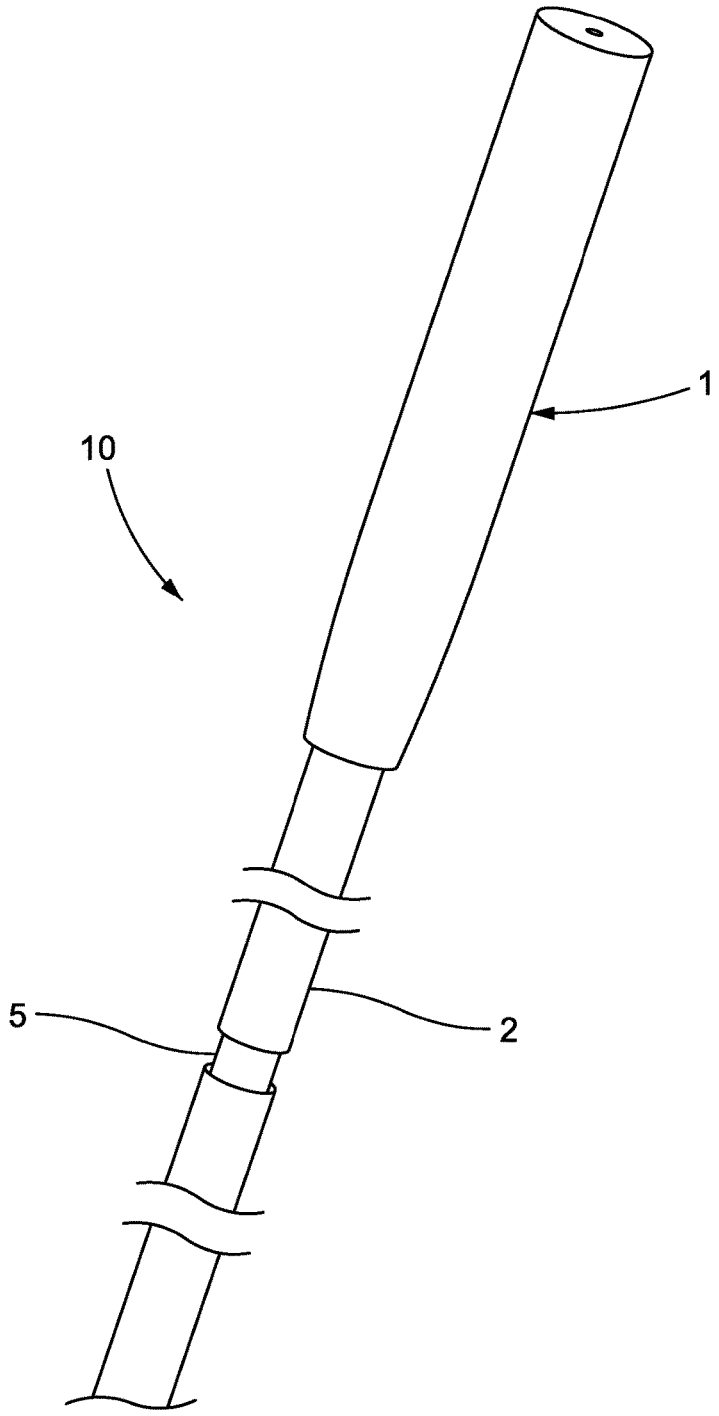
FIG. 15 illustrates a putting training golf club according to an exemplary embodiment of the present invention.

In another exemplary embodiment, the angular rotation mechanism 5 may be located on or in the shaft 2, as shown in FIG. 15. In this exemplary embodiment, the angular rotation mechanism 5 allows the lower portion of shaft 2*a* to rotate about an axis of rotation relative to the upper portion of shaft 2*b*. As in the previous embodiment, the amount of rotation will depend, at least in part, on the way the golf ball was struck during the putting stroke. In this exemplary embodiment, the angular rotation mechanism 5 may be omitted from the head 3. However, a third exemplary embodiment is possible where an angular rotation mechanism 5 is included in the head 3 and the shaft 2. Separate shafts 2 each with difference angular rotation mechanisms 5 may be provided in the same manner. Moreover, the angular rotation mechanism 5 may be located in the grip 1 or any multiple combinations of grip 1, shaft 2, and putter head, as described in relation to FIGS. 1-3.

Figure 16:
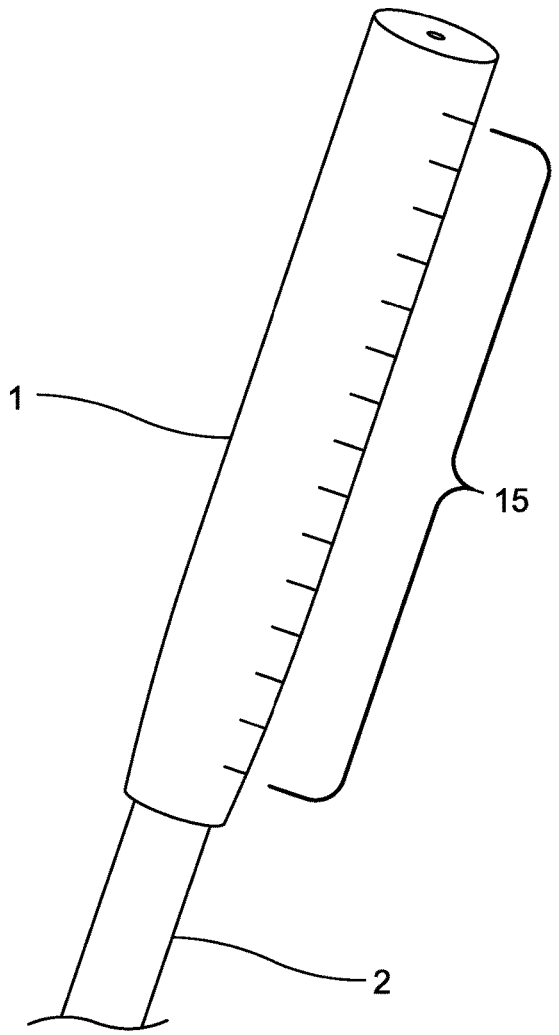
FIG. 16 illustrates an exemplary grip for a training golf club according to the current disclosure.

FIG. 16 illustrates a grip 1 that includes a scale or series of graduation marks 15. The graduation marks 15 delineate spaces, presumably uniform spaces, from one end of the grip 1 to the opposite end of the grip 1. The graduation marks 15 may be used by the golfer to experiment with and determine preferred hand positioning on the grip 1. The graduation marks 15 may be delineated by lines, dots, depression, bumps, numbers, characters, or any other suitable method.

Figure 17:
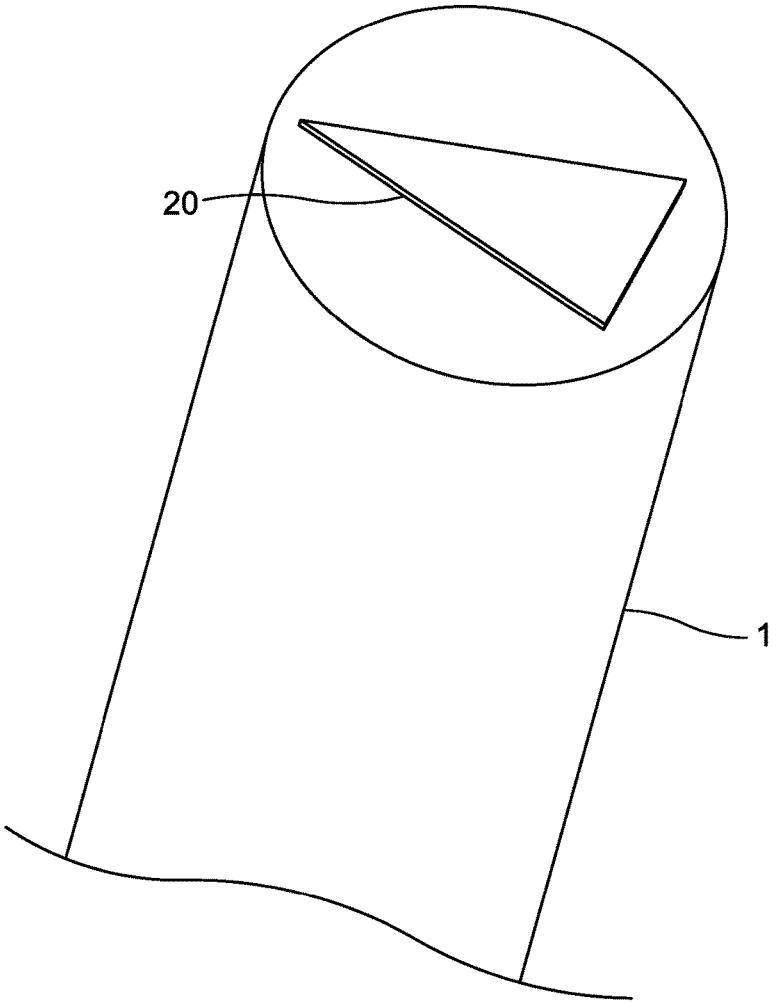
FIG. 17 illustrates an orientation device for a golf club according to the current disclosure.

FIG. 17 shows an orientation device 20 that may provide a visual aid to orient the club with relation to the golf ball and putting target line or the hole. The orientation device 20 as shown is located at one end of the grip 1. The orientation device 20 could be in a fixed position on the grip 1 or may be rotatable. The orientation device 20 may be detachable from the grip 1. As shown, the orientation device 20 is triangular shaped, however, other shapes or designs are possible that may provide an aid to club orientation. Further, the orientation device 20 may be incorporated into the grip 1 as supplied with the putting training device or may be fitted into a golfer's club for use while playing.

Figure 18:
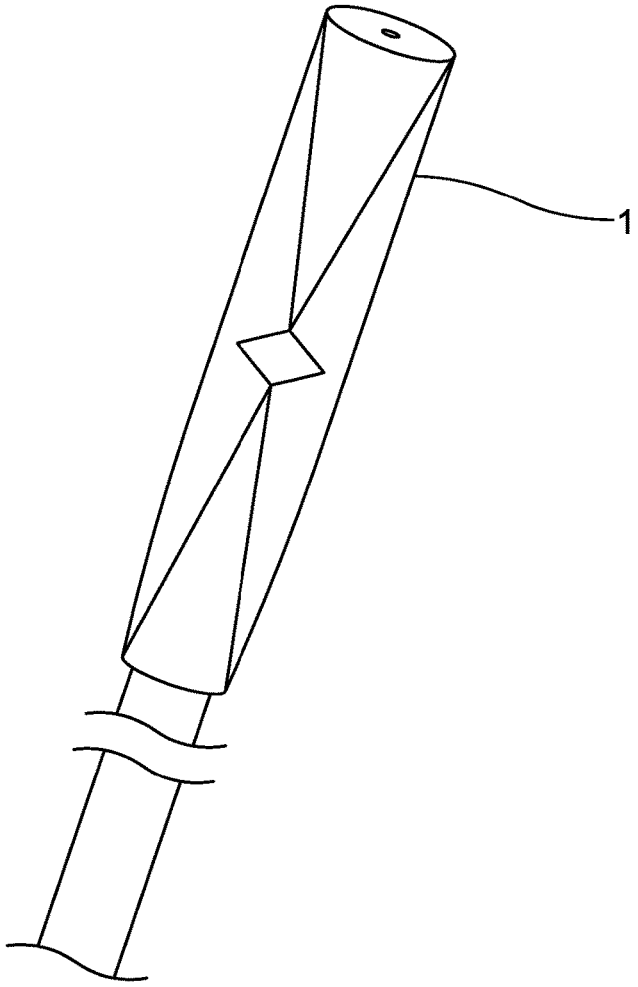
FIG. 18 illustrates an exemplary grip for a training golf club according to the current disclosure.

FIG. 18 illustrates a grip design. The grip design pattern, as shown, may include any colors as decorative features of the design pattern. The grip design pattern may further include inlays or different materials than the remainder of the grip 1.

In a further exemplary embodiment, the shaft 2 may be removable and replaced with another shaft. In accordance with this embodiment, the golfer may be able to adjust the angle θ of the shaft 2 relative to the head 3.

In still another exemplary embodiment, the head 3 may be removable and replaced by another head 3, where each head 3 may exhibit a different shape, rotational resistance, and/or visual indicators.

Similarly, exchangeable shafts may be employed, each exhibiting a different angle θ, angular rotational resistance, and/or visual indicators.

Figure 19:
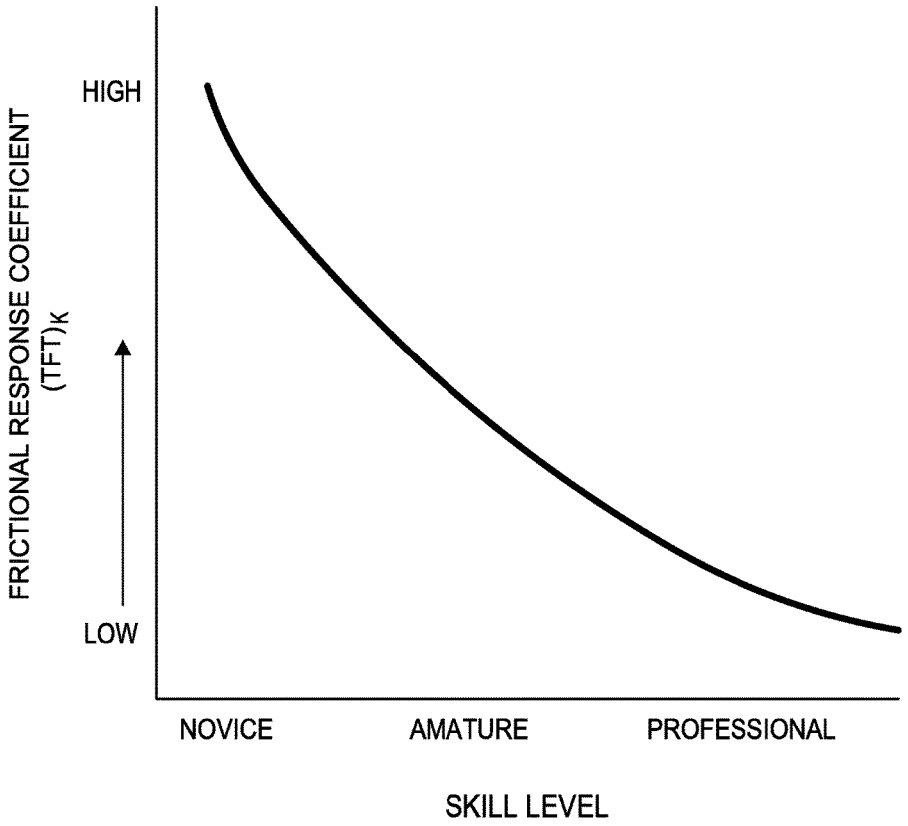
FIG. 19 illustrates an exemplary performance utilization curve for a variable friction rotational device according to the current disclosure.

FIG. 19 illustrates a curve generally characterizing the use of the variable resistance adjustment feature in the putting training device. More specifically, the curve represents a frictional response coefficient, (TFT)K (vertical axis) as a function of golfer skill level (horizontal axis). The curve illustrates how the variable resistance of the angular rotation mechanism 5 is typically higher for novice golfers and lower for more experienced golfers. Thus, as a golfer improves, the resistance can be progressively lowered thereby minimizing resistance and increasing the propensity of the head 3 to rotate when the golfer miss hits the ball. This allows the golfer to build confidence while improving. In other words, rotational resistance can be decreased as the golfer's putting stroke proficiency improves, thereby increasing the challenge and fine tuning the golfer's stroke mechanics.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A golf club device comprising:

a shaft;

a grip disposed about a top portion of the shaft;

a head having a cross sectional shape when viewed from above where the cross sectional shape is not symmetrical about a center between the front and back of the head; and an angular rotation mechanism including a rolling element located in the head to allow the head to rotate relative to the shaft in a plane parallel to a bottom surface of the head, wherein the head cannot be fixed in a rotational orientation to the shaft.

2. The club device of claim 1, wherein the angular rotation mechanism comprises a variable resistance mechanism.

3. The club device of claim 1, wherein the angular rotation mechanism comprises a bearing.

4. The club device of claim 1, wherein the grip includes a plurality of uniformly spaced graduation marks.

5. The club device of claim 4, further comprising an orientation device detachably coupled to the end of the grip, the orientation device being rotatable about the end of the grip.

6. The club device of claim 1, wherein the head is replaceable.

7. The club device of claim 1, wherein the shaft is replaceable.

8. The club device of claim 1, wherein an alignment indicator to indicate the relative position of the head to the shaft, the alignment indicator comprising a first alignment mark located on the head and a second alignment mark located on the angular rotation mechanism, whereby an amount of angular deviation between the first and second alignment marks varies and provides visual feedback to a user after striking a ball with a head.

9. The club device of claim 1, wherein the rolling element is embedded in the head flush with or below a top surface of the head.

10. The club device of claim 1, wherein a top surface is planar.

11. The club device of claim 1, wherein the rolling element is located only at a top half portion of the head.

* * * * *